US009784009B2

(12) United States Patent
Choi

(10) Patent No.: US 9,784,009 B2
(45) Date of Patent: Oct. 10, 2017

(54) INTEGRATED TENT HAVING MULTIPLE TENT UNITS

(71) Applicant: Campvalley (Xiamen) Co., Ltd., Xiamen (CN)

(72) Inventor: Kwanjun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 15/080,316

(22) Filed: Mar. 24, 2016

(65) Prior Publication Data

US 2016/0281385 A1 Sep. 29, 2016

(30) Foreign Application Priority Data

Mar. 24, 2015 (CN) ..... 2015 2 0166946 U

(51) Int. Cl.
*E04H 15/48* (2006.01)

(52) U.S. Cl.
CPC ..... *E04H 15/48* (2013.01)

(58) Field of Classification Search
CPC ..... E04H 15/48; E04H 15/18; E04H 15/34
USPC ..... 135/97, 143, 147
See application file for complete search history.

(56) References Cited

U.S. PATENT DOCUMENTS 14,655 A 4/1856 Hartwell
58,283 A 9/1866 Palmer
379,274 A 3/1888 Hamilton
1,061,547 A 5/1913 Kennedy
1,129,194 A 2/1915 Hanley
1,347,107 A 7/1920 McCann
1,687,722 A * 10/1928 Goldberg ..... E04H 15/34 135/140
2,113,118 A 4/1938 Pyatt
2,227,554 A 1/1941 Riordon
2,306,706 A 12/1942 Lucas
(Continued)

FOREIGN PATENT DOCUMENTS

CA 2 022 369 A1 2/1991
CN 1076987 A 10/1993
(Continued)

OTHER PUBLICATIONS

U.S. Appl. No. 14/762,139, filed Dec. 16, 2016.
(Continued)

*Primary Examiner* — Noah Chandler Hawk
(74) *Attorney, Agent, or Firm* — Morgan, Lewis & Bockius LLP

(57) ABSTRACT

An integrated tent includes a plurality of tent units. Each tent unit includes a pole connector, a plurality of upper poles, a plurality of lower poles and a tent cloth. Each upper pole has a first end and a second end, with the first end pivotally connected to the pole connector. Each lower pole has a first end and a second end, with the first end pivotally connected to the second end of a corresponding upper pole. An integrated tent also includes one or more unit connectors, and a plurality of connecting poles for connecting the tent units. Each unit connector is disposed between two adjacent tent units. Each connecting pole has a first end pivotally connected to the pole connector of a corresponding tent unit and a second end pivotally connected to a corresponding unit connector.

15 Claims, 6 Drawing Sheets

(56) References Cited

U.S. PATENT DOCUMENTS 2,448,895 A 9/1948 Lawrence
2,530,765 A 11/1950 Greenup
2,555,220 A 5/1951 Brown
2,716,993 A 9/1955 Coderick
2,731,972 A 1/1956 Braun
2,948,287 A 8/1960 Rupert
2,962,034 A 11/1960 Finlayson
2,984,249 A 5/1961 Sears, Jr. et al.
3,054,413 A 9/1962 Eshelman
3,333,373 A 8/1967 Taylor et al.
3,738,378 A 6/1973 Williams
3,766,932 A 10/1973 Sidis
3,810,482 A 5/1974 Beavers
3,929,146 A 12/1975 Maiken
4,003,181 A 1/1977 Robinson
4,037,978 A 7/1977 Connelly
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,285,355 A 8/1981 Lundblade
4,627,210 A 12/1986 Beaulieu
4,637,748 A 1/1987 Beavers
4,750,509 A 6/1988 Kim
4,787,182 A 11/1988 Serge
4,819,680 A 4/1989 Beavers
4,838,003 A 6/1989 Zeigler
4,941,499 A 7/1990 Pelsue et al.
4,944,321 A 7/1990 Moyet-Ortiz
4,971,090 A 11/1990 Uhl
4,998,552 A 3/1991 Niksic et al.
5,230,358 A 7/1993 Forell
5,240,020 A 8/1993 Byers
5,255,698 A * 10/1993 Riley ..... E04H 15/34 135/142
5,263,507 A 11/1993 Chuang
5,293,890 A 3/1994 Park et al.
5,328,286 A 7/1994 Lee
5,333,634 A 8/1994 Taylor
5,361,794 A 11/1994 Brady
5,423,341 A 6/1995 Brady
5,617,681 A 4/1997 Lyons
5,628,338 A 5/1997 Stumbo
5,634,483 A 6/1997 Gwin
5,666,986 A 9/1997 Fox
5,701,923 A 12/1997 Losi, Jr. et al.
5,732,726 A 3/1998 Lee
5,771,651 A * 6/1998 Shiina ..... E04H 15/48 135/143
5,771,654 A 6/1998 Moore et al.
5,797,695 A 8/1998 Prusmack
5,884,646 A 3/1999 Ju
5,943,837 A 8/1999 Esser et al.
6,021,795 A 2/2000 Long et al.
6,032,430 A 3/2000 Soukup
6,167,898 B1 1/2001 Larga et al.
6,283,136 B1 9/2001 Chen
6,286,530 B1 9/2001 Hussey
6,296,415 B1 10/2001 Johnson et al.
6,463,948 B2 10/2002 Lee
6,516,823 B1 2/2003 Glover et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 8/2004 Chen
6,854,476 B1 2/2005 Chai
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,299,813 B2 11/2007 Ochi
7,311,113 B2 12/2007 Suh
7,316,239 B2 1/2008 Yang
7,392,610 B2 7/2008 Jedlicka
RE40,544 E 10/2008 Suh
7,481,235 B2 1/2009 Prusmack
7,546,845 B2 6/2009 Prusmack
7,607,447 B1 10/2009 Han
7,810,514 B2 10/2010 Lah
7,861,736 B2 1/2011 Choi
8,047,218 B1 11/2011 Shin
8,056,573 B2 * 11/2011 Panigot ..... E04H 15/48 135/144
8,069,872 B2 12/2011 Bae
8,156,952 B2 4/2012 Chesness
8,186,369 B2 5/2012 Reeb
8,469,045 B2 6/2013 Zhou
8,485,208 B2 7/2013 Seo
8,590,554 B2 11/2013 Choi
D705,884 S 5/2014 Jin
8,910,648 B2 12/2014 Jin
9,051,034 B1 * 6/2015 Tarr ..... B63B 17/02
9,140,030 B2 9/2015 Jin
9,243,423 B2 1/2016 Jin
9,382,723 B2 * 7/2016 Choi ..... E04H 15/32
2001/0050098 A1 12/2001 Lee
2003/0005953 A1 1/2003 Erbetta et al.
2006/0016467 A1 1/2006 Bae
2006/0289048 A1 12/2006 Choi
2007/0051399 A1 3/2007 Jung
2007/0215192 A1 9/2007 Hoffman
2009/0173369 A1 7/2009 Lah
2012/0055525 A1 3/2012 Choi
2012/0318316 A1 12/2012 Choi et al.
2013/0014794 A1 1/2013 Jin
2013/0247948 A1 9/2013 Lovley et al.
2014/0076372 A1 * 3/2014 Jin ..... E04H 15/46 135/139
2014/0109945 A1 4/2014 Jin
2014/0246062 A1 9/2014 Ma
2014/0261601 A1 9/2014 Jin
2014/0290710 A1 10/2014 Choi
2014/0311540 A1 10/2014 Choi
2015/0068573 A1 * 3/2015 Jin ..... E04H 15/42 135/147
2015/0083177 A1 3/2015 Hotes
2015/0167343 A1 6/2015 Fang
2015/0167344 A1 * 6/2015 Li ..... E04H 15/48 135/143
2015/0275541 A1 10/2015 Lamke
2016/0060897 A1 * 3/2016 Baoqing ..... E04H 15/405 135/146
2016/0281385 A1 9/2016 Choi
2016/0290003 A1 10/2016 Yang

FOREIGN PATENT DOCUMENTS

CN 2401649 Y 10/2000
CN 2506736 Y 8/2002
CN 2635827 Y 8/2004
CN 2697225 Y 5/2005
CN 201013097 Y 1/2008
CN 201103269 Y 8/2008
CN 201129060 Y 10/2008
CN 201202302 Y 3/2009
CN 102691439 A 9/2012
CN 201220478761.4 9/2012
CN 202767622 U 3/2013
CN 203034904 U 7/2013
CN 103590650 B 2/2014
CN 204163467 U 2/2015
FR 1 121 851 8/1956
GB 2 201 703 A 9/1988
GB 2 259 927 A 3/1993
KR 10-2011-0054253 A 5/2011
KR WO 2014181953 A1 * 11/2014 ..... E04H 15/008
WO WO 2011/022764 A1 3/2011
WO WO 2013/116545 A1 8/2013

(56) References Cited

FOREIGN PATENT DOCUMENTS

OTHER PUBLICATIONS

U.S. Appl. No. 14/753,989, filed Jun. 29, 2015.
U.S. Appl. No. 14/270,965, filed May 6, 2014.
U.S. Appl. No. 14/280,845, filed May 19, 2014.
U.S. Appl. No. 14/292,024, filed May 30, 2014.
U.S. Appl. No. 14/910,979, filed Jun. 28, 2016.
U.S. Appl. No. 15/170,566, filed Jun. 1, 2016.
U.S. Appl. No. 15/170,587, filed Jun. 1, 2016.
U.S. Appl. No. 15/217,835, filed Jul. 22, 2016.

* cited by examiner

INTEGRATED TENT HAVING MULTIPLE TENT UNITS

CROSS-REFERENCE TO RELATED APPLICATIONS

The present application claims priority of Chinese Utility Model Application CN 201520166946.5 filed on Mar. 24, 2015, the entire contents of which application are incorporated herein for all purposes by this reference.

FIELD OF THE INVENTION

The present invention generally relates to tents, and more particularly, to integrated tents with multiple tent units connected by connectors.

BACKGROUND

As economies prosper, more and more people are able to enjoy their leisure time in outdoor activities such as camping or fishing. Tents are widely used as a means to provide shade and resting places. For ease of transport, tents are generally configured to be foldable or detachable. One example of such a tent is disclosed in Chinese Publication No. CN100173799C, entitled "Automatic Folding Tent". The folding tent of CN100173799C includes an automatic folding member, upper poles, lower poles, and a tent cloth member. The automatic folding member is on the top and at the center of the tent. The upper poles are pivotally connected to the automatic folding member. The lower poles are adjustable and pivotally connected to the upper poles. The tent cloth is fixed on the upper and lower poles.

Although these tents can provide shade and resting places, they usually have low resistance to wind. To improve the resistance to wind and the stability of tents, two approaches are most generally utilized. The first approach is to increase the number of pegs pinning the tent on the ground. While this approach can improve stability, the assembly and installation of such a tent takes a longer time than a comparable tent anchored with fewer pegs. The second approach is to redesign the entire tent frame (e.g., folding mechanisms, upper and lower poles). This approach has yet to provide a truly satisfactory result.

Given the current state of the art, there remains a need for a tent that addresses the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide integrated tents with improved stability are disclosed below.

In one embodiment, the present invention provides an integrated tent including a plurality of tent units, one or more unit connectors, and a plurality of connecting poles. Each tent unit includes a pole connector, a plurality of upper poles, a plurality of lower poles and a tent cloth. Each upper pole has a first end and a second end, with the first end pivotally connected to the pole connector. Each lower pole has a first end and a second end, with the first end pivotally connected to the second end of a corresponding upper pole. The tent cloth is arranged on the plurality of upper poles and the plurality of lower poles. Each unit connector is disposed between two adjacent tent units. Each connecting pole has a first end pivotally connected to the pole connector of a corresponding tent unit and a second end pivotally connected to a corresponding unit connector.

In various embodiments, the present invention provides an integrated tent including a plurality of tent units, one or more unit connectors, and a plurality of connecting poles. The plurality of tent units includes a first tent unit and a second tent unit adjacent to the first tent unit. Each of the first tent unit and the second tent unit includes a pole connector, a plurality of upper poles, a plurality of lower poles and a tent cloth. Each upper pole has a first end and a second end, with the first end pivotally connected to the pole connector. Each lower pole has a first end and a second end, with the first end pivotally connected to the second end of a corresponding upper pole. The tent cloth is arranged on the plurality of upper poles and the plurality of lower poles. The one or more unit connectors include a first unit connector disposed between the first and second tent units. The plurality of connecting poles includes a first connecting pole and a second connecting pole. Each of the first connecting pole and second connecting pole includes a first end and a second end. The first end of the first connecting pole is pivotally connected to the pole connector of the first tent unit and the second end of the first connecting pole is pivotally connected to the first unit connector. The first end of the second connecting pole is pivotally connected to the pole connector of the second tent unit and the second end of the second connecting pole is pivotally connected to the first unit connector.

In some embodiments, an integrated tent of the present invention further includes one or more supporting poles. One end of an exemplary first supporting pole is connected to the first unit connector and the other end of the exemplary first supporting pole is configured to abut on a ground. In an exemplary embodiment, the exemplary first supporting pole has a length, which is telescopically adjustable.

In various embodiments, when the integrated tent is unfolded, the first connecting pole and the second connecting pole are positioned substantially co-linearly.

In some embodiments, an exemplary first unit connector includes a first protrusion set and a second protrusion set, each having a front protrusion and a rear protrusion. The second end of the first connecting pole is disposed between the front and rear protrusions of the first protrusion set of the first unit connector and pivotally connected to the front and rear protrusions of the first protrusion set of the first unit connector. The second end of the second connecting pole is disposed between the front and rear protrusions of the second protrusion set of the first unit connector and pivotally connected to the front and rear protrusions of the second protrusion set of the first unit connector.

In some embodiments, the first unit connector further includes a cylindrical body, a connecting sleeve, a plurality of fixing members and a plurality of links. The cylindrical body has an upper end and a lower end, and the first and second protrusion sets are fixedly coupled with or monolithically formed with the upper end of the cylindrical body. The connecting sleeve is slideably coupled with the lower end of the cylindrical body. The plurality of fixing members includes a first fixing member coupled with the second end of the first connecting pole and a second fixing member coupled with the second end of the second connecting pole. The plurality of links includes a first link and a second link. One end of the first link is pivotally coupled with the connecting sleeve and the other end of the first link is pivotally coupled with the first fixing member. One end of the second link is pivotally coupled with the connecting sleeve and the other end of the second link is pivotally coupled with the second fixing member.

In some embodiments, the cylindrical body is formed with a through hole along a longitudinal direction of the cylindrical body. In such embodiments, the first unit connector further includes a spring, a washer, a limiting nut, a cover and a bolt. The spring is disposed within the through hole of the cylindrical body and abuts on the connecting sleeve. The washer is disposed above the spring, and the limiting nut is disposed above the washer. The cover is disposed above the limiting nut and fixedly coupled with the top of the cylindrical body. The bolt passes through the connecting sleeve, the spring and the washer, and is coupled with the limiting nut. In some embodiments, the connecting sleeve includes a first slot for receiving the first end of the first link and a second slot for receiving the first end of the second link.

In some embodiments, lengths of at least one of the first connecting pole and the second connecting pole are adjustable and, in some cases, are telescopically adjustable. In some embodiments, when a tent unit is unfolded, the pole connector of the tent unit is positioned at the top of the tent unit and substantially in the radial center of the tent unit. In some embodiments, the first tent unit and second tent unit (and higher order tent units) are substantially the same as each other.

The systems of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of an integrated tent having multiple tent units and connectors for connecting adjacent tent units. As used herein, tent units include but are not limited to conventional tents, and can be of various sizes and shapes.

Figure 1:
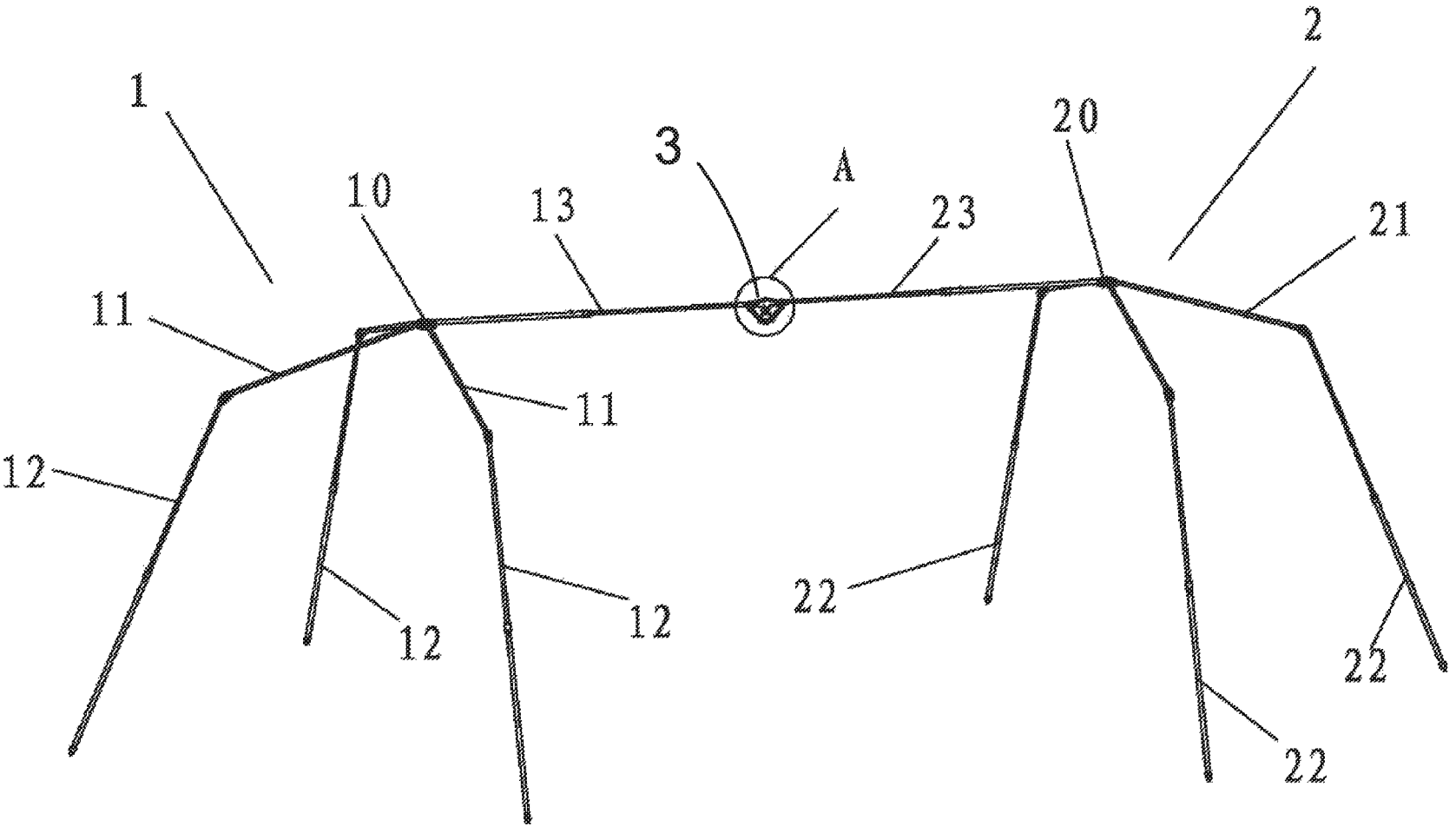
FIG. 1 is a schematic view illustrating an exemplary integrated tent in accordance with exemplary embodiments of the present invention.
Figure 5:
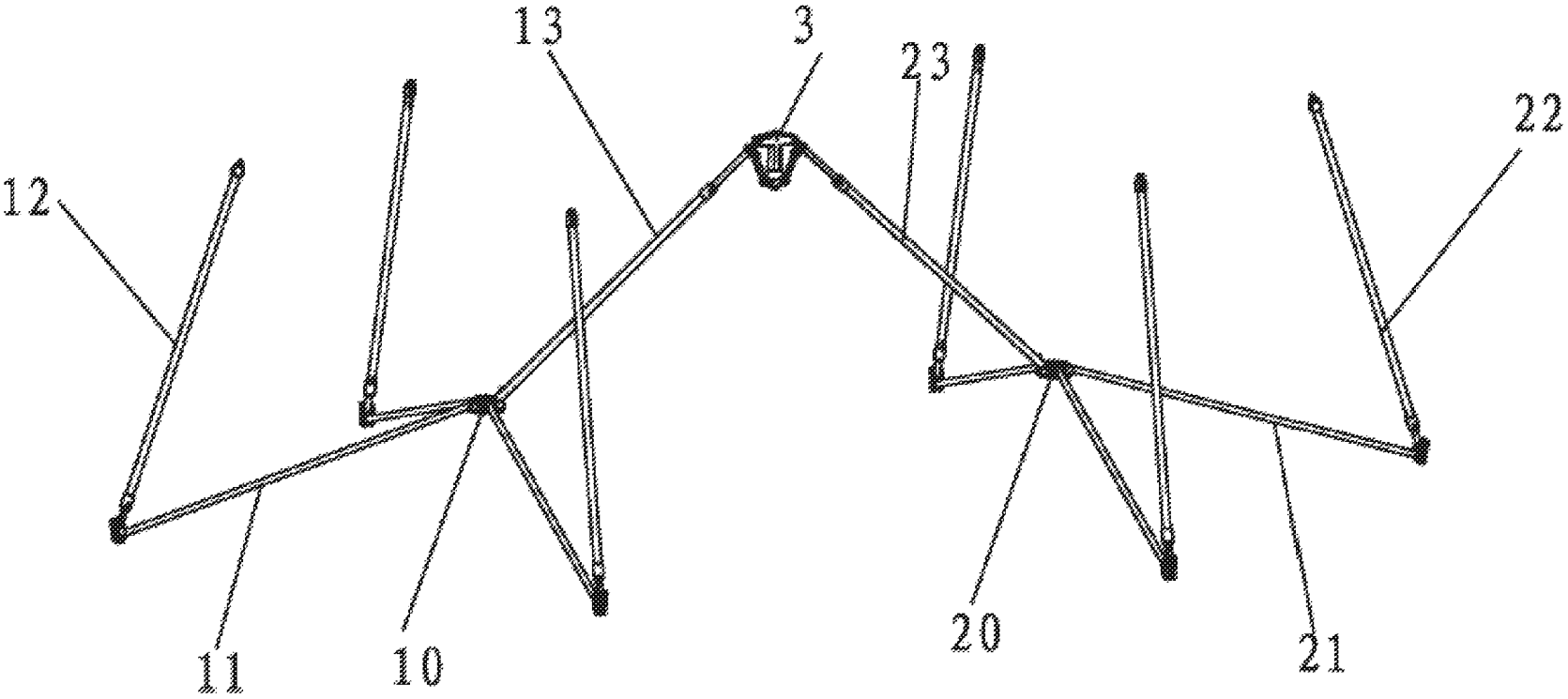
FIG. 5 is a schematic view illustrating an exemplary integrated tent in a state between fully folded and fully extended states in accordance with exemplary embodiments of the present invention.

Referring to FIGS. 1 and 5, in some embodiments, an integrated tent of the present invention includes a plurality of tent units such as first tent unit 1 and second tent unit 2. An integrated tent of the present invention also includes one or more unit connectors such as unit connector 3 and a plurality of connecting poles such as first connecting pole 13 and second connecting pole 23 for connecting the tent units.

First tent unit 1 and second tent unit 2 are disposed adjacent to each other. Each of the first tent unit and the second tent unit includes a pole connector, a plurality of upper poles, a plurality of lower poles and a tent cloth. For example, first tent unit 1 includes pole connector 10, a plurality of upper poles 11 and a plurality of lower poles 12. One end of each upper pole 11 is pivotally connected to pole connector 10 so that upper poles can rotate toward or away from each other (e.g., folding or unfolding). The other end of each upper pole 11 is pivotally connected to an end of a corresponding lower pole 12. In some embodiments, when tent unit 1 is unfolded, pole connector 10 is positioned at the top and substantially in the radial center of tent unit 1.

Similarly, second tent unit 2 includes pole connector 20, a plurality of upper poles 21 and a plurality of lower poles 22. One end of each upper pole 21 is pivotally connected to pole connector 20 so that upper poles can rotate toward or away from each other (e.g., folding or unfolding). The other end of each upper pole 21 is pivotally connected to an end of a corresponding lower pole 22. In some embodiments, when tent unit 2 is unfolded, pole connector 20 is positioned at the top and substantially in the radial center of tent unit 2.

In some embodiments, length of lower poles 12 and 22 are adjustable and in some embodiments are telescopically adjustable.

In some embodiments, each tent unit includes a tent cloth arranged on the plurality of upper poles and the plurality of lower poles. The tent cloth is similar to or the same as those in the conventional art. For the purpose of illustration of tent frames, the tent cloth is not shown in the drawings.

It should be understood that an integrated tent of the present invention can include more than two tent units such as three, four or any suitable numbers of tent units. Also, tent units such as first tent unit 1 and second tent unit 2 do not necessarily need to be the same as or similar to each other. Further, it is not necessarily for each tent unit to include a separate tent cloth; an integrated tent of the present invention can include one tent cloth covering all tent units that are connected to each other.

Continuously referring to FIGS. 1 and 5, unit connector 3 is disposed between first tent unit 1 and second tent unit 2. The first end of first connecting pole 13 is pivotally connected to pole connector 10 of first tent unit 1 and the second end of first connecting pole 13 is pivotally connected to unit connector 3. The first end of second connecting pole 23 is pivotally connected to pole connector 20 of second tent unit 2 and the second end of second connecting pole 23 is pivotally connected to unit connector 3.

In a preferred embodiment, the integrated tent is configured such that when unfolded, first connecting pole 13 and second connecting pole 23 are positioned substantially on the same line, and in some case at the same elevation or forming a straight line. In another preferred embodiment, one or both of first connecting pole 13 and second connecting pole 23 are adjustable in length, and in some cases telescopically adjustable in length.

Figure 4:
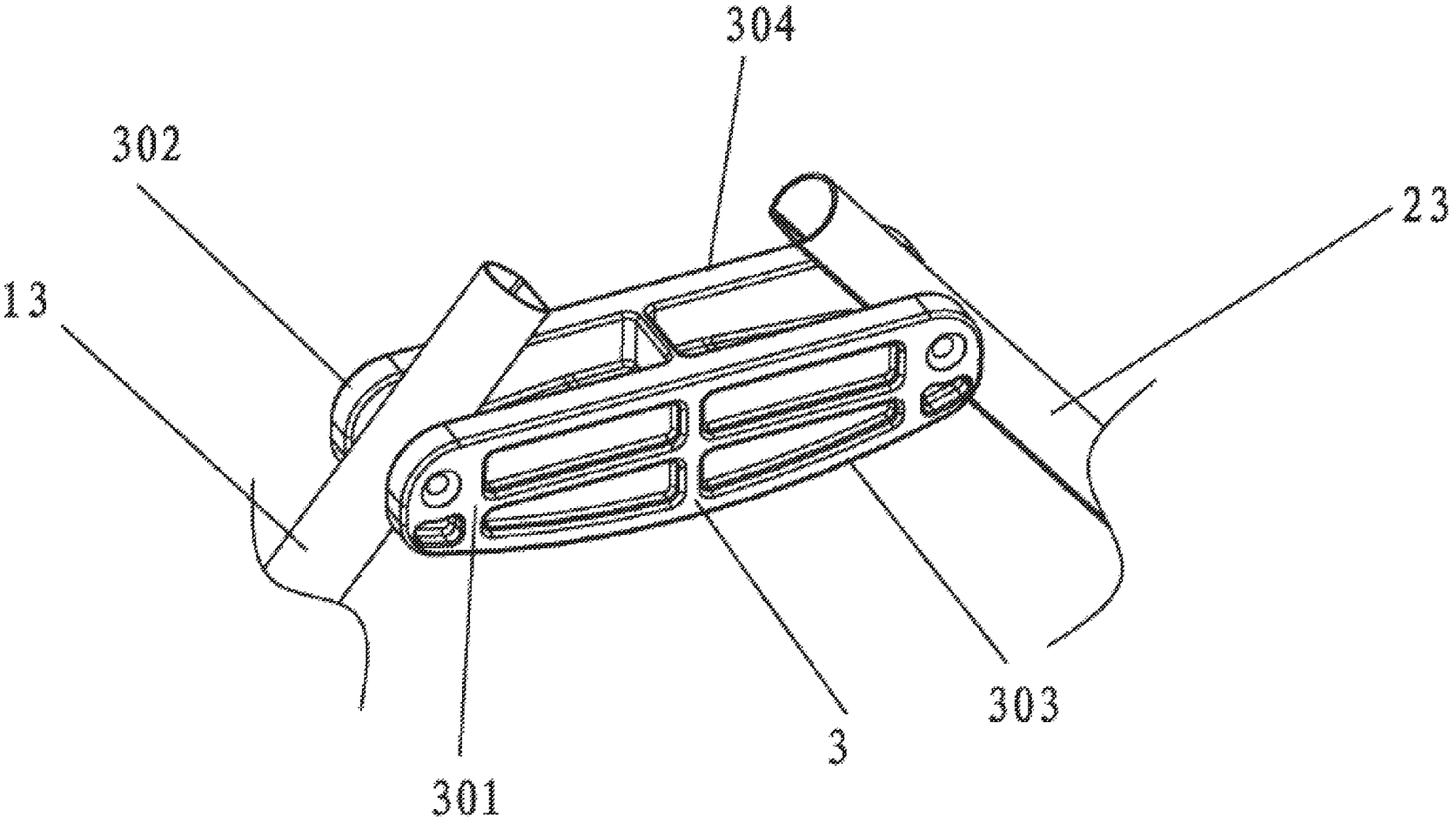
FIG. 4 is a perspective view illustrating an exemplary connector in accordance with exemplary embodiments of the present invention.

Referring to FIG. 4, in some embodiments, unit connector 3 includes a first protrusion set composed of first front protrusion 301 and first rear protrusion 302 and a second protrusion set composed of second front protrusion 303 and second rear protrusion 304. In such embodiments, the second end of first connecting pole 13 is disposed in the slot between the first front and rear protrusions of the first protrusion set and pivotally connected to the first front and rear protrusions of the first protrusion set. The second end of second connecting pole 23 is disposed in the slot between the second front and rear protrusions of the second protrusion set and pivotally connected to the second front and rear protrusions of the second protrusion set.

Figure 2:
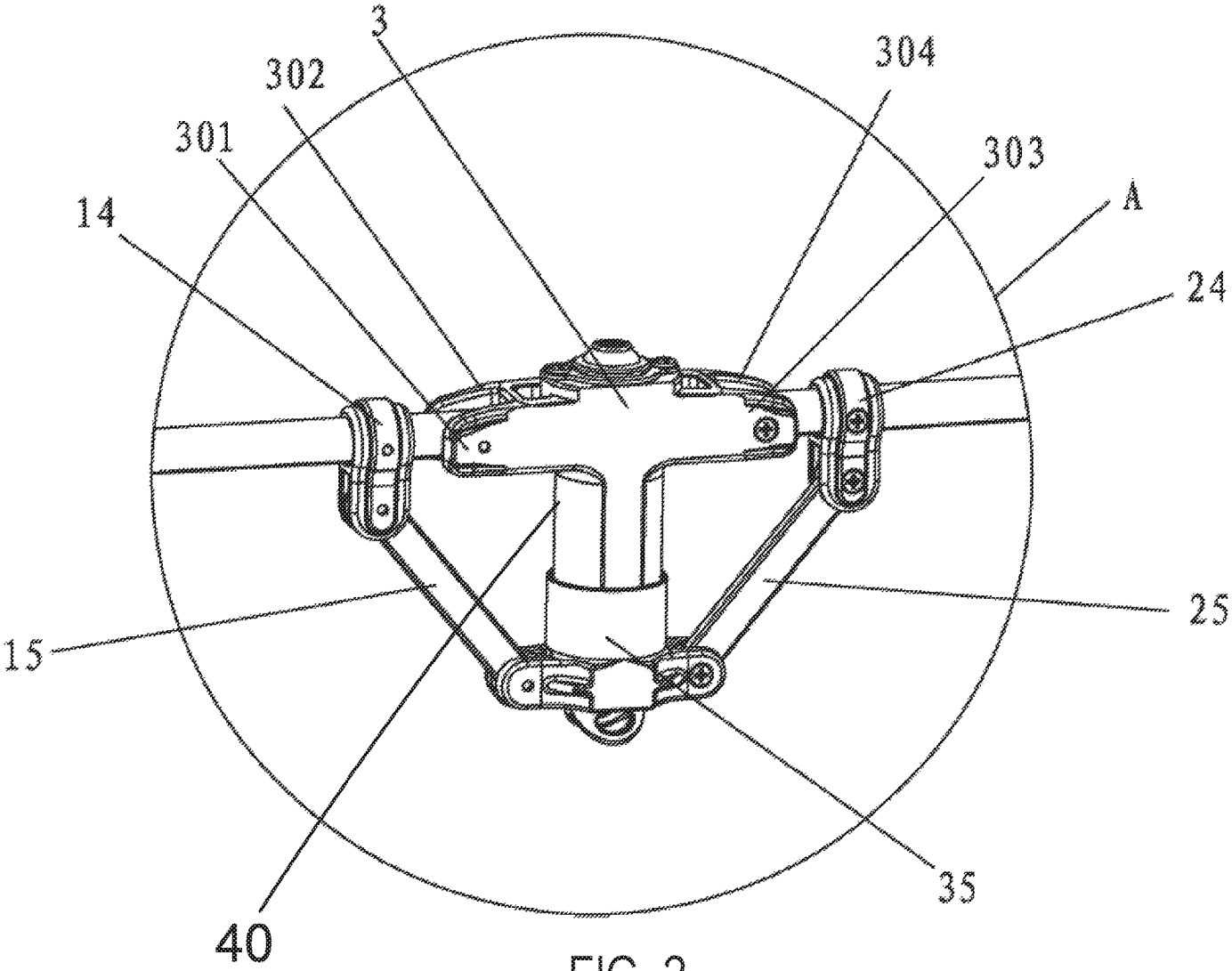
FIG. 2 is an enlarged view of elements within circle A in FIG. 1.
Figure 3:
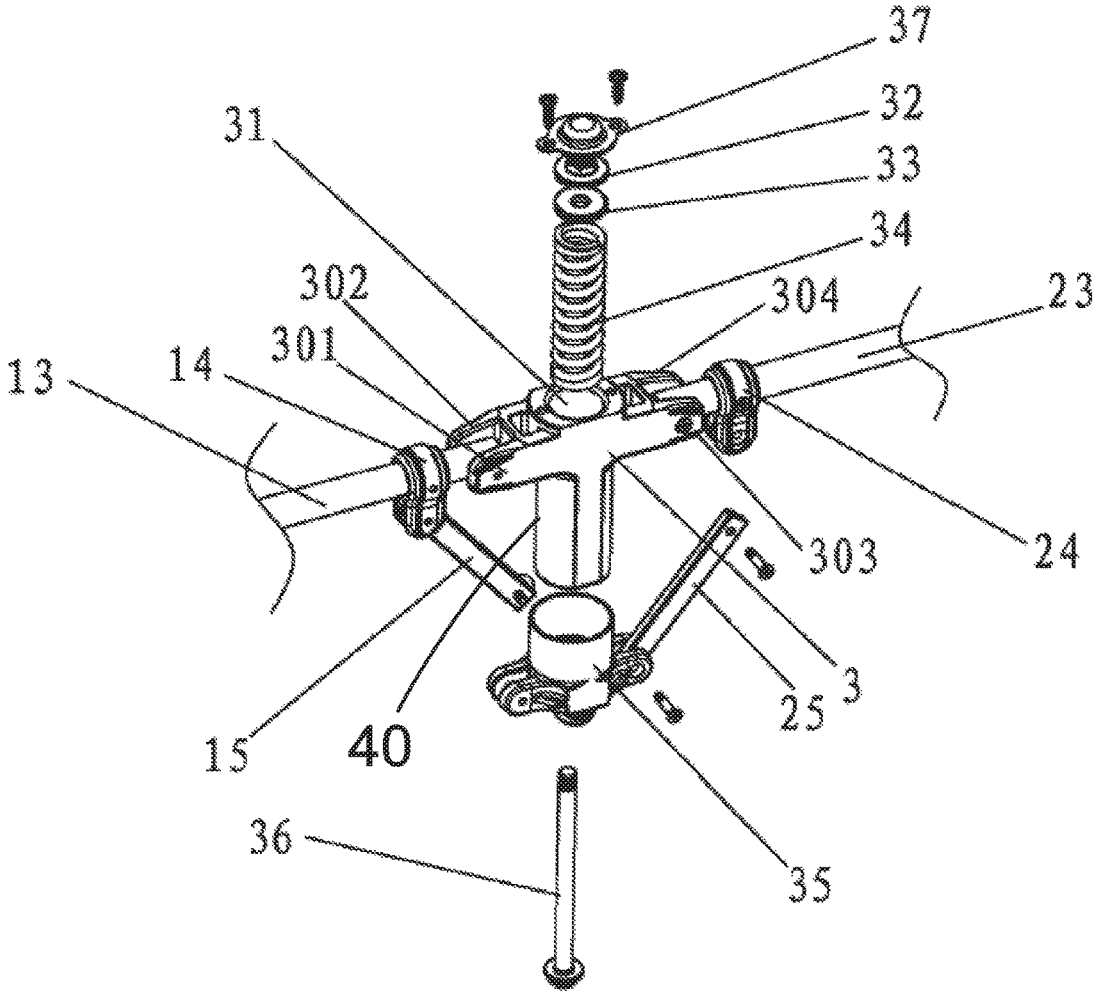
FIG. 3 is a partially disassembled view illustrating an exemplary connector in accordance with exemplary embodiments of the present invention.

In some embodiments, unit connector 3 includes alternative, additional or optional features. For example, as illustrated in FIGS. 2 and 3, in some embodiments, unit connector 3 further includes a cylindrical body such as cylindrical body 40, a connecting sleeve such as connecting sleeve 35, a plurality of fixing members such as first fixing member 14 and second fixing member 24, and a plurality of links such as first link 15 and second link 25. In the illustrated embodiment, the first and second protrusion sets are fixedly coupled with or monolithically formed with the upper end of the cylindrical body, and the connecting sleeve is slidably coupled with the lower end of the cylindrical body. The first fixing member is coupled with the second end of the first connecting pole, and the second fixing member is coupled with the second end of the second connecting pole. One end of the first link is pivotally coupled with the connecting sleeve and the other end of the first link is pivotally coupled with the first fixing member. One end of the second link is pivotally coupled with the connecting sleeve and the other end of the second link is pivotally coupled with the second fixing member.

In some embodiments, cylindrical body 40 is formed with through hole 31 along a longitudinal direction of the cylindrical body. In an exemplary embodiment, unit connector 3 further comprises elastic member or spring 34, washer 33, limiting nut 32, cover 37 and bolt 36. When assembled, the spring is disposed within the through hole of the cylindrical body and abuts on the connecting sleeve. The washer is disposed above the spring and the limiting nut is disposed above the washer. The spring, washer and limiting nut are movable within the through hole. The cover is disposed above the limiting nut and fixedly coupled with the cylindrical body and in some cases coupled with the top of the cylindrical body (e.g., by screws or other suitable means). As such, cover 37 secures limiting nut 32, washer 33 and spring 34 in through hole 31. Bolt 36 passes through connecting sleeve 35, spring 34 and washer 33, and is coupled with limiting nut 32.

Adjusting bolt 36 (e.g., rotating bolt 36 clockwise or counterclockwise) changes the tension of spring 34. When the first and second tent units are unfolded, spring 34 abuts on sleeve 35 which in turn creates a tension in first connecting pole 13 and second connecting pole 23. As a result, it strengthens the connection between first connecting pole 13 and second connecting pole 23 and thus improves the stability of the integrated tent.

In some embodiments, as shown in FIGS. 2 and 3, connecting sleeve 35 includes engaging slots for receiving the first end of first link 15 and the first end of second link 25.

Figure 6:
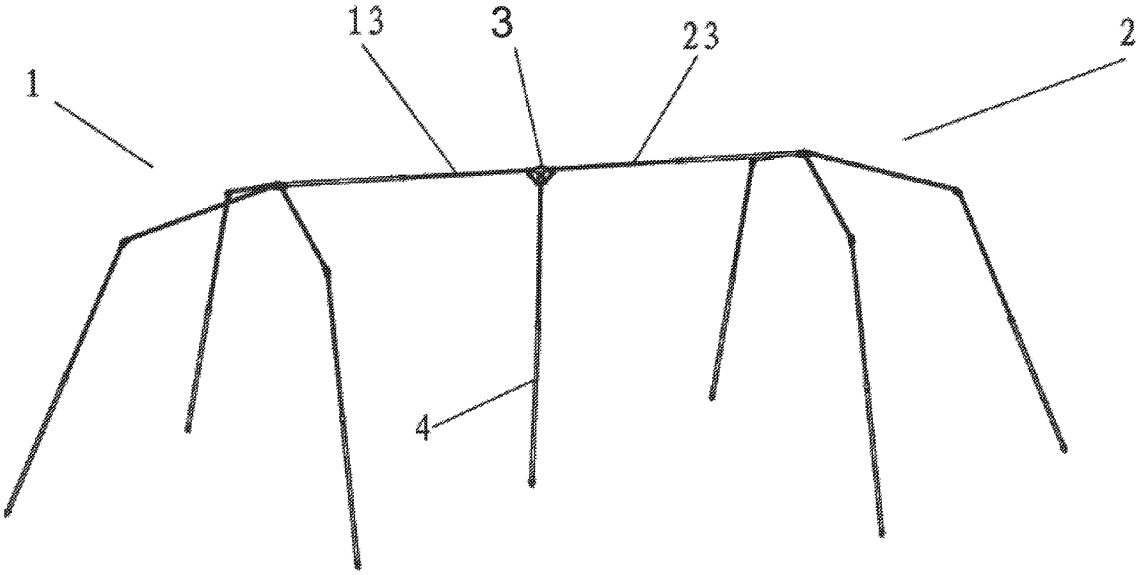
FIG. 6 is a schematic view illustrating an exemplary integrated tent in accordance with exemplary embodiments of the present invention.

In some embodiments, an integrated tent of the present invention includes alternative, additional or optional features to further improve the stability of the integrated tent. For example, in some embodiments, an integrated tent of the present invention further includes one or more supporting poles such as supporting pole 4 illustrated in FIG. 6. Supporting pole 4 has one end connected to unit connector 3 and the other end configured to contact a ground, e.g., abut on the ground. In a preferred embodiment, the length of supporting pole 4 is adjustable and in some cases telescopically adjustable.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "front" or "rear", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first tent unit could be termed a second tent unit, and, similarly, a second tent unit could be termed a first tent unit, without changing the meaning of the description, so long as all occurrences of the "first tent unit" are renamed consistently and all occurrences of the "second tent unit" are renamed consistently.

What is claimed is:

1. An integrated tent, comprising:

a plurality of tent units comprising a first tent unit and a second tent unit adjacent to the first tent unit, wherein each of the first tent unit and the second tent unit comprises:

a pole connector;

a plurality of upper poles, each having a first end and a second end, wherein the first end of each upper pole is pivotally connected to the pole connector a plurality of lower poles, each having a first end and a second end, wherein the first end of each lower pole is pivotally connected to the second end of a corresponding upper pole; and one or more unit connectors comprising a first unit connector disposed between the first and second tent units, wherein the first unit connector comprises a first protrusion set and a second protrusion set, each protrusion set comprising a front protrusion and a rear protrusion;

a plurality of connecting poles comprising a first connecting pole and a second connecting pole, each of the first connecting pole and second connecting pole comprising a first end and a second end, wherein:

the first end of the first connecting pole is pivotally connected to the pole connector of the first tent unit and the second end of the first connecting pole is pivotally connected to the first unit connector wherein the second end of the first connecting pole is disposed between the front and rear protrusions of the first protrusion set of the first unit connector and pivotally connected thereto; and the first end of the second connecting pole is pivotally connected to the pole connector of the second tent unit and the second end of the second connecting pole is pivotally connected to the first unit connector, wherein the second end of the second connecting pole is disposed between the front and rear protrusions of the second protrusion set of the first unit connector and pivotally connected thereto;

the first unit connector further comprises:

a cylindrical body having an upper end and a lower end, wherein the first and second protrusion sets are fixedly coupled with or monolithically formed with the upper end of the cylindrical body;

a connecting sleeve slidably coupled with the lower end of the cylindrical body;

a plurality of fixing members comprising a first fixing member coupled with the second end of the first connecting pole and a second fixing member coupled with the second end of the second connecting pole; and a plurality of links comprising a first link and a second link, wherein one end of the first link is pivotally coupled with the connecting sleeve and the other end of the first link is pivotally coupled with the first fixing member, and one end of the second link is pivotally coupled with the connecting sleeve and the other end of the second link is pivotally coupled with the second fixing member.

2. The integrated tent of claim 1, further comprising:

one or more supporting poles comprising a first supporting pole, one end of which is connected to the first unit connector and the other end of which is configured to abut on a ground.

3. The integrated tent of claim 2, wherein the first supporting pole has a telescopically adjustable length.

4. The integrated tent of claim 1, wherein, when the integrated tent is unfolded, the first connecting pole and the second connecting pole are positioned substantially colinearly.

5. The integrated tent of claim 1, wherein the cylindrical body is formed with a through hole along a longitudinal direction thereof, the first unit connector further comprises:

a spring disposed within the through hole of the cylindrical body and abutting on the connecting sleeve;

a washer disposed above the spring;

a limiting nut disposed above the washer;

a cover disposed above the limiting nut and fixedly coupled with a top of the cylindrical body; and a bolt passing through the connecting sleeve, the spring and the washer, and coupled with the limiting nut.

6. The integrated tent of claim 1, wherein the connecting sleeve comprises a first slot for receiving the first end of the first link and a second slot for receiving the first end of the second link.

7. The integrated tent of claim 1, wherein lengths of the first connecting pole and the second connecting pole are adjustable.

8. The integrated tent of claim 1, wherein lengths of the first connecting pole and the second connecting pole are telescopically adjustable.

9. The integrated tent of claim 1, wherein lengths of the lower poles are telescopically adjustable.

10. The integrated tent of claim 1, wherein when a tent unit is unfolded, the pole connector of the tent unit is positioned at a top of the tent unit and substantially in a radial center of the tent unit.

11. The integrated tent of claim 1, wherein first tent unit and second tent unit are substantially the same as each other.

12. An integrated tent, comprising:

a plurality of tent units, each comprising:

a pole connector;

a plurality of upper poles, each having a first end and a second end, wherein the first end of each upper pole is pivotally connected to the pole connector;

a plurality of lower poles, each having a first end and a second end, wherein the first end of each lower pole is pivotally connected to the second end of a corresponding upper pole; and one or more unit connectors, each disposed between two adjacent tent units, wherein one or each unit connector in the one or more unit connectors is formed with slots for receiving the second ends of the plurality of connecting poles;

a plurality of connecting poles, wherein each connecting pole has a first end pivotally connected to the pole connector of a corresponding tent unit and a second end pivotally connected to a corresponding unit connector, the one or each unit connector further comprises:

a cylindrical body having an upper end and a lower end, wherein the slots are formed by protrusions fixedly coupled with or monolithically formed with the upper end of the cylindrical body;

a connecting sleeve slidably coupled with the lower end of the cylindrical body;

a plurality of fixing members, each slidably coupled with the second end of a corresponding connecting pole; and a plurality of links, each having one end pivotally coupled with the connecting sleeve and the other end pivotally coupled with a corresponding fixing member.

13. The integrated tent of claim 12, further comprising:

one or more supporting poles, each having one end connected to a corresponding unit connector and the other end configured to abut on a ground.

14. The integrated tent of claim 12, wherein lengths of the first connecting pole and the second connecting pole are adjustable.

15. The integrated tent of claim 12, wherein lengths of the first connecting pole and the second connecting pole are telescopically adjustable.

* * * * *